US006354130B1

(12) United States Patent
Santa Cruz et al.

(10) Patent No.: US 6,354,130 B1
(45) Date of Patent: Mar. 12, 2002

(54) METHOD FOR BENDING A CORRUGATED SHEET

(76) Inventors: Cathy D. Santa Cruz, 7630 Tholl Dr., Reno, NV (US) 89506; Wayne R. Sandstrom, P.O. Box 549, Wadsworth, NV (US) 89442

( * ) Notice: Subject to any disclaimer, the term of this patent is extended or adjusted under 35 U.S.C. 154(b) by 0 days.

(21) Appl. No.: 09/668,845

(22) Filed: Sep. 22, 2000

(51) Int. Cl.[7] ..... B21D 28/10; B21D 31/06; B21D 13/08

(52) U.S. Cl. ..... 72/324; 72/385; 72/379.6; 428/134; 428/182

(58) Field of Search ..... 72/324, 332, 385, 72/379.6; 29/897.32; 428/182, 134, 43, 155

(56) References Cited

U.S. PATENT DOCUMENTS

| | | | | | |
|---|---|---|---|---|---|
| 2,123,842 | A | * | 7/1938 | Cox | 72/339 |
| 2,505,554 | A | * | 4/1950 | Kravitz | 428/134 |
| 4,603,572 | A | * | 8/1986 | Van Breukelen | 72/385 |
| 5,303,572 | A | * | 4/1994 | Knudson | 72/385 |
| 5,361,476 | A | * | 11/1994 | Leopold | 29/417 |
| 5,750,235 | A | * | 5/1998 | Yoshimasa | 428/182 |

* cited by examiner

*Primary Examiner*—Daniel C. Crane

(57) ABSTRACT

A method for bending a corrugated product, such as composite decking, building panels, or the like. With the method being easily performed by any workman on the job site, and the only tools needed are a saw and a hammer. Also this method allows the workman to easily bend the product into any desired angle of their choice, and forms a weather proof bend which is extremely strong.

1 Claim, 2 Drawing Sheets

METHOD FOR BENDING A CORRUGATED SHEET

FIELD OF THE INVENTION

This invention relates to methods used for bending corrugated materials such as typical composite decking, or the like. However, the present invention more particularly pertains to a method for bending the corrugated sheet transversely of the corrugations in a manner which is simple, requires no additional apparatus, and can be easily be performed on the job site by any workman using only a saw and hammer.

BACKGROUND OF THE INVENTION

Corrugated sheets have been used for a very long time for construction of various buildings, such as storage shed's, barns, roofs, etc. However, such types of corrugated sheets are extremely difficult to bend transversely of the corrugations. Thus use of such building materials has been somewhat limited as the sheets cannot be easily shaped during construction at the job site which is most unfortunate. Therefore this is a major problem and must be resolved in an affordable efficient manner.

This problem has been recognized and addressed within the prior art but it still remains to be unresolved in an appropriate manner. For example, U.S. Pat. No. 5,062,286 entitled "METHOD AND APPARATUS FOR BENDING CORRUGATED SHEET" is functional for its intended use but it still has inherent disadvantages which the present invention clearly eliminates and overcomes. For example, the cited reference allows the workman to bond the sheet at the point of construction but the sheet can only be bent along a pre-determined manufactured fold-line. Thus, the desired location of the bend must be anticipated at the point of manufacture and this defeats the entire purpose and desired end result of the invention.

Other examples of the known prior art include U.S. Pats. #3,842,647 and #4,449,388 each of which provide means for bending metal corrugated sheets. However, each teach costly machinery and complicated apparatus which the present invention completely eliminates.

It is therefore contended that there is a great need for an improved means for bending corrugated sheets during construction at the job site without the use of additional apparatus or machinery.

SUMMARY OF THE INVENTION

It is a very important object of the present invention to provide a method for bending pre-formed sheets and which can be utilized for all existing types of shaped or corrugated metal sheets.

It is a very important object of the present invention to provide a method for bending pre-formed sheets which renders possible the bending of such shaped sheet up to at least 90°.

It is another object of the present invention to provide a method for bending pre-formed corrugated sheets which can be easily performed in three easy steps that heretofore have not been taught within the known prior art.

It is another very important object of the present invention is to provide a method for bending pre-formed corrugated sheet's which can be performed on the job site by any workman having a saw and hammer.

Yet another important object of the present invention is to provide a method for bending pre-formed sheet's which does not require additional machinery or apparatus.

Still another object of the present invention is to provide a method for bending pre-formed corrugated sheet's which actually strengthens the sheet due to metal composition properties and inherent characteristics.

Also another important object of the present invention is to provide a method for bending pre-formed sheet's which allows the workman to bend the sheet at any desired angle of choice and at any location on the sheet.

Still another object of the present invention is to provide a method for bending pre-formed corrugated sheet's which provides a bend that is substantially water proof.

Yet another very important object is to provide a method for bending pre-formed corrugated sheet's which allows the workman on the work site to shape the sheet into the desired form. This is most important as this allows one sheet to be used to form a roof and a wall in combination, or a floor and wall, etc.

Other objects and advantages will be seen when taken into consideration with the following specification and drawings.

DETAILED DESCRIPTION OF THE DRAWINGS

Referring now in detail to the drawings wherein like characters refer to like elements throughout the various views.

Within FIGS. 1–4 (10) represents an overview of the present invention which is a method for bending a corrugated sheet (12) transversely of its corrugations. It is to be understood any type of corrugated sheet may be bent using the present method, thus the present method is not to be limited to use with any particular type of corrugated sheet (12).

FIGS. 1–4 illustrate a portion of a typical corrugated sheet (12) which can be made from any suitable material of engineering choice, such as metal, aluminum, etc. and can be of any suitable shape or size. Such as a corrugated sheet (12) which is formed with multiple elongated upraised projections (14) which are substantially parallel to each other and extend lengthwise along the entire length of corrugated sheet (12). With each of the multiple elongated upraised projections being separated from each other by interconnecting flat section's (16).

Figure 1:
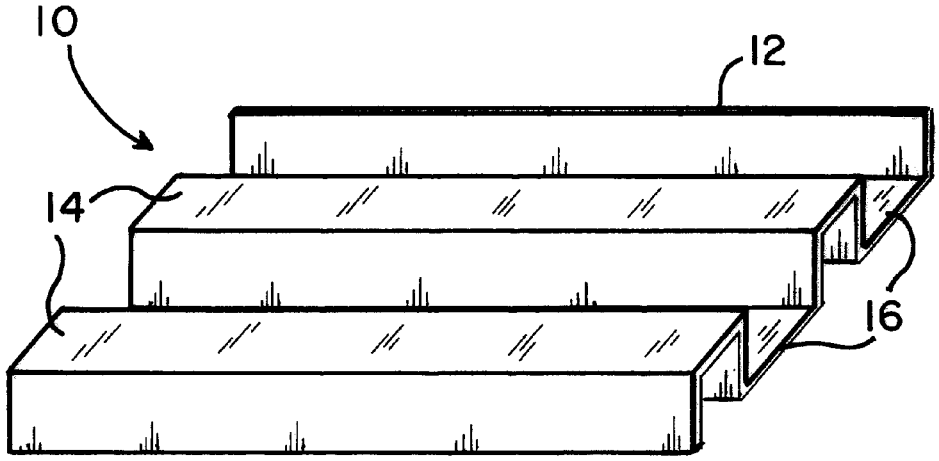
FIG. 1 is substantially a perspective sectional view of a typical corrugated sheet.
Figure 2:
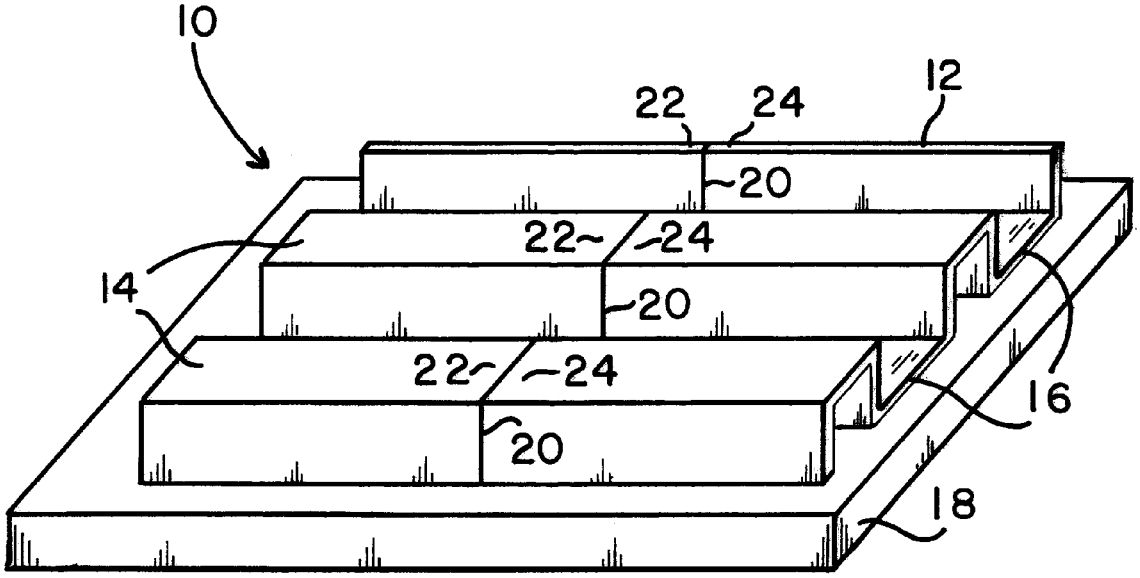
FIG. 2 is substantially a perspective plan view illustrating the first step of the present method used for bending a corrugated sheet.

Referring now to the method of the present invention for bending a corrugated sheet (12) transversely of its corrugations comprising the steps of:

The first step of the present method is positioning a corrugated sheet (12) longitudinally onto a flat work surface (18) as illustrated in FIG. 2. It is to be noted any suitable work surface (18) of choice may be used, such as a worktable, a floor, or even the ground surface if level. It is to be further noted that when corrugated sheet (12) is properly positioned upon the work surface (18), the interconnecting flat sections (16) are substantially the only contact between corrugated sheet (12) and work surface (18).

The second step of the present method is cutting a slit (20) transversely completely through each of the elongated upraised projections (14), without cutting into any of the interconnecting flat sections (16). Thus, forming a first cut end (22) which is substantially opposed to a second cut end (24) on each elongated upraised projection (14), as clearly illustrated in FIG. 2. It is to be understood any suitable type of cutting instrument may be used for cutting corrugated sheet (12) depending on the workman's preference, such as a saw or the like. However, it is important that each of the slits (20) be aligned with each other along the desired bend line, as each of the slits (20) in combination form the bend, respectively, when the method steps are completed.

Figure 3:
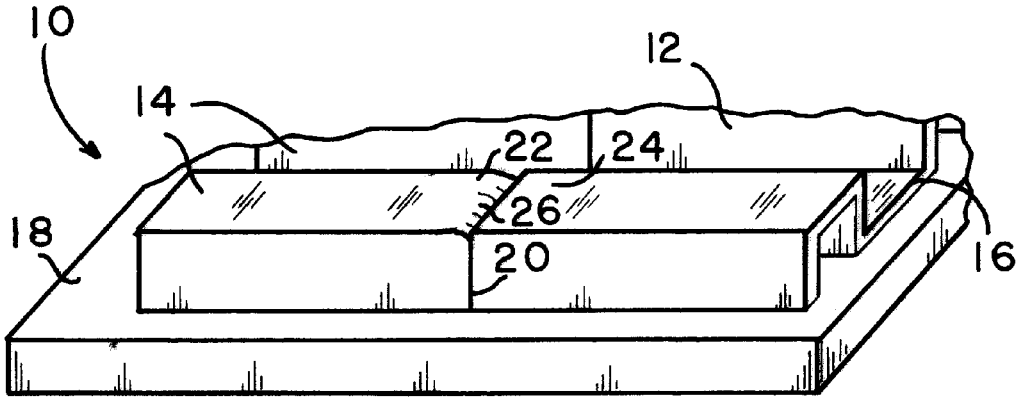
FIG. 3 is substantially a perspective plan view illustrating the second step of the present method used for bending a corrugated sheet.

The third step of the present method is forming a dimple (26) on each first cut end (22), as illustrated in FIG. 3. This substantially deforming each first cut end (22) in a downward direction respective to each opposed second cut end (24). It is to be noted this can be easily achieved using a typical hammer, or the like.

Figure 4:
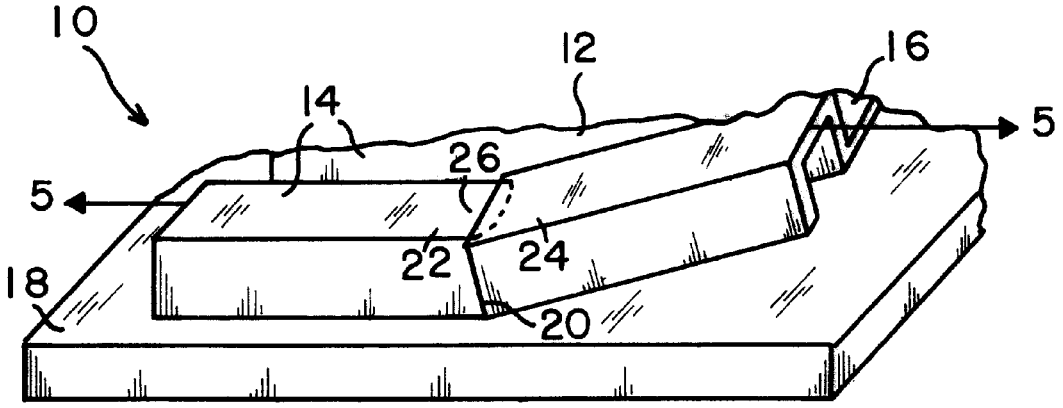
FIG. 4 is substantially a perspective plan view illustrating the third step of the present method used for bending a corrugated sheet.

The fourth step of the present method is manually bending corrugated sheet (12) until corrugated sheet (12) is bent into the desired shape, or rather the angle of workman's choice. It is to be understood this bending motion automatically forces each first cut end (22) in a downward direction into each opposed second cut end (24) respectively, as illustrated in FIG. 4.

The fifth step of the present method is manually turning corrugated sheet (12) over onto its opposite side, respectively.

Figure 5:
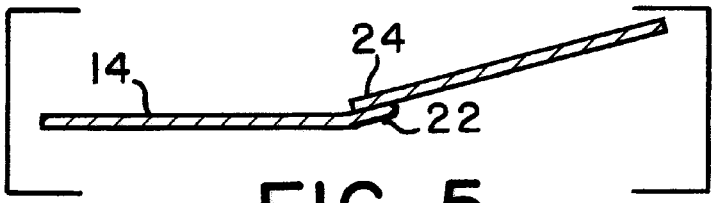
FIG. 5 is substantially a sectional view taken at 5—5 of FIG. 4, and illustrates the fourth step of the present method used for bending a corrugated sheet.

The sixth and final step of the present method is hammering and forcing each first cut end (22) into the desired position. Whereby, each first cut end (22) and each opposed second cut end (24) have a close mating relationship there between, as clearly illustrated within FIGS. 4 and 5.

It can now be seen we have herein provided a unique method for bending a corrugated sheet (12) transversely of its corrugations which has not heretofore been taught.

It can also now be seen we have herein provided a method for bending a corrugated sheet (12) transversely of its corrugations which allows a workman on the job site to make or form the bend at any angle of choice. As there is no limit as to how far the corrugated sheet (12) can be bent.

It can further be seen we have herein provided a method for bending a corrugated sheet (12) transversely of its corrugations which forms a weather-proof bend and does not weaken the corrugated sheet (12) in any manner, in fact the corrugated sheet (12) is strongest at the point of the bend.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and desire to secure by Letters Patent is:

1. A method for bending a corrugated sheet transversely of its corrugations comprising the steps of:

a. positioning a corrugated sheet longitudinally onto a flat work surface, said corrugated sheet being formed with multiple elongated upraised projections which are parallel to each other and extend lengthwise along said corrugated sheet, said multiple elongated upraised projections being separated from each other by interconnecting flat sections, thus when said corrugated sheet is properly positioned upon said work surface said interconnecting flat sections are the only contact between said corrugated sheet and said work surface;

b. cutting a slit transversely completely through each elongated upraised projection, thus forming a first cut end which is opposed to a second cut end on each said elongated upraised projection;

c. forming a dimple on each said first cut end;

d. bending said corrugated sheet until said corrugated sheet is bent into the desired shape, thus automatically forcing each said first cut end into each opposed said second cut end;

e. turning said corrugated sheet over onto the opposite side; and;

f. hammering each said first cut end into position, whereby:

each said first cut end and each opposed said second cut end have a close mating relationship there between.

* * * * *